US006463832B1

(12) United States Patent
Cox

(10) Patent No.: US 6,463,832 B1
(45) Date of Patent: Oct. 15, 2002

(54) CAPPED HEAD HAMMER

(75) Inventor: Michael L. Cox, Lewistown, IL (US)

(73) Assignee: Vaughan & Bushnell Manufacturing Company, Hebron, IL (US)

( * ) Notice: Subject to any disclaimer, the term of this patent is extended or adjusted under 35 U.S.C. 154(b) by 0 days.

(21) Appl. No.: 09/512,398

(22) Filed: Feb. 24, 2000

(51) Int. Cl.[7] ..... B25D 1/12
(52) U.S. Cl. ..... 81/22; 81/25
(58) Field of Search ..... 81/20, 21, 22, 81/25

(56) References Cited

U.S. PATENT DOCUMENTS 1,045,145 A * 11/1912 Hubbard ..... 81/22
1,732,985 A * 10/1929 Peters ..... 81/22
1,781,344 A * 11/1930 Salazar ..... 81/22
1,792,153 A * 2/1931 Evich ..... 81/25
2,198,764 A * 4/1940 Edwards ..... 81/22
2,491,295 A * 12/1949 Anderson ..... 81/25
2,515,931 A 7/1950 Ulfves
2,518,059 A 8/1950 Permerl
2,592,883 A 4/1952 Fisher
2,884,969 A 5/1959 Lay
2,952,284 A * 9/1960 Nichols et al. ..... 81/19
3,000,414 A 9/1961 Cordis
3,148,716 A * 9/1964 Vaughan, Jr. ..... 81/22
6,016,722 A 1/2000 Gierer

* cited by examiner

*Primary Examiner*—Joseph J. Hail, III
*Assistant Examiner*—Joni B. Danganan
(74) *Attorney, Agent, or Firm*—David Thimmig; Mayer, Brown, Rowe & Maw

(57) ABSTRACT

A hammer having a hammer head and a cap removably slidably fitted to the hammer head. A biasable pad for absorbing shock is positioned between the cap and the hammer head. A cross-pin connects the cap and hammer head while permitting slidable movement therebetween.

60 Claims, 4 Drawing Sheets

CAPPED HEAD HAMMER

FIELD OF THE INVENTION

The present invention relates to the field of hammers and more particularly to the field of replaceable caps for hammers.

DESCRIPTION OF THE PRIOR ART

The striking face of a hammer is often subjected to forces that require extra toughness and hardness. Because of the heavy duty usage of certain hammers, the impact faces wear out more rapidly than normal hammers. One example of this type of hammer is the framing hammer, used in the art of house building. Such types of hammer are heavier than the average hammer, and in order to eliminate the cost of manufacturing an entire hammer that includes a unitary head that meets the toughness required, it is known in the art to attach a separate hammer head portion, or capped head, or cap, at the end area, or poll, of the hammer head. Such caps, which are often made of a strong but heavy metal such as stainless steel, are known in the art.

Hammers have various types of striking faces, for example, flat faces and knurled faces. In addition, hammers having heavy duty striking faces often require different versions of the rear region of the hammer head, for example, a claw and a ball peen. A replaceable cap having a tough striking face thus has another application.

In another area of the art of hammers, shock absorbing structures that reduce shock to the hands and arms of users during impact are known. Combining such shock absorbing structures with a replaceable cap is also known.

Patents relating to the art of hammers that disclose various aspects of capped heads are as follows:

1) Patents that disclose detachable, or replaceable, head caps combined with shock-absorbing cushions or washers known in the art of hammers are as follows:

U.S. Pat. No. 2,518,059 issued to M. Permerl on Aug. 8, 1950, discloses a mallet having interchangeable percussion heads 14 and 17 removably screwed to a mallet head 10. Interposed between the inner end face of percussion members 14 and 17 are washers 16 and 23, respectively, which are made of a resilient material such as rubber.

U.S. Pat. No. 3,000,414 issued to N. Cordis on Sep. 19, 1961, discloses a hammer 10 having a hammer head 12 and a replaceable, or "floating", striking head 15 and provided with an elongated stud 16 that is accommodated by a bore 17 in hammer head 12. A flexible, resilient sleeve 20 connects floating head 15 to hammer head 12. FIGS. 2–5 show a resilient sleeve 29 that includes a supplemental integral cap 23 providing a rim 24 about striking head 15. Sleeve 20 is capable of withstanding the impact and the constant flexing in its cushioning action. Sleeve 20 also grips the snub-nose tip 14 os hammer head 12 and holds striking head 15 in an alternative embodiment as shown in FIGS. 2–5.

2) A patent disclosing a removable and replaceable capped head is as follows:

U.S. Pat. No. 2,515,431 issued to C. A. Ulfves on Jul. 18, 1950, discloses a unitary detachable hammer tip set forth in FIG. 2 that includes a core 16, a ring 30, and arcuate spring fingers 24 having reversibly bent gripping elements 26. The entire detachable tip is removably attached to conventional hammer head 10 as shown in FIG. 1.

3) Patents relating to the art of hammers disclosing hammers with cushions or washers or structures for absorbing shock between a separate but non-replaceable cap and the hammer head proper are as follows:

U.S. Pat. No. 1,045,145 issued to E. O. Hubbard on Nov. 26, 1912, discloses a capped hammer head 1 provided with a shock-absorbing rubber cushion 19 for a separate head proper, or cap 10. FIG. 1 shows a cap 10 has a threaded stud 13 screwed into a retaining head 1 mounted inside a sleeve 5 that in turn is threaded onto a reduced threaded portion 4 of head 1. FIGS. 4 and 5 show variations on the particular structure.

U.S. Pat. No. 1,732,985 issued to R. H. Peters on Oct. 22, 1929, discloses a hammer attachment, or cap, including a sleeve 1 and a rubber striking head 7 is secured by clamping means 12 upon a hammer head 15 with a washer 9 fit against a seat 3 connected to stroking head 7 positioned within sleeve 1 is described. It is apparent that washer 9 absorbs pressure exerted by hammer head 15.

U.S. Pat. No. 2,198,764, issued to B. E. Edwards on Apr. 30, 1940, discloses a metal working hammer having a hammer head 6 having a floating striking element 11 that is movably secured to a stationary hammer striking element 8 positioned in a cylindrical body portion 12 having a bottom, or strike face 13. A shock-absorbing element, or cushion, 15, is housed in cylindrical body portion 12 between bottom strike face 13 and stationary element 8.

U.S. Pat. No. 2,592,883 issued to C. J. Fisher on Apr. 15, 1952, discloses a hand hammer body 10 having a hammer head 16 with an arcuate hammer face 18. A resilient striking member 22 made of resilient carbon spring steel or similar material is mounted over arcuate face 18 so that a recess is defined between striking member 22 and arcuate face 18. In use, when an indented piece of metal is struck with the hammer, the resilient member 22 will flex inwardly toward the recessed face 18 tending to close the hollow space between face 18 and member 22. Immediately thereafter, the spring action of member 22 with cause the member to flex outwardly again. This inward and outward action imparts a spring-like action and resilience to the hammer head.

U.S. Pat. No. 3,148,716 issued to H. A. Vaughan, Jr. on Sep. 15, 1964, discloses a composite hammer head 10 comprised of a main body portion 11 and an impact tip, or cap 12. The front end face 64 of main body portion 11 forms a socket 62. Impact tip 12 is metallic and includes a striking face 46 and a rear tapered shank 44 press-fitted into socket 62. A washer 66 formed of a shock-absorbing material surrounding the base of shank 44 is interposed between striking head 42 and front end face 64. The combined thickness of washer 66 and the depth of socket 62 is slightly greater than the axial extent of shank 44 so that a sealed air pocket 72 is created in the bottom region of socket 62 absorbs some of the impact that is imparted to impact tip 12.

U.S. Pat. No. 2,884,969 issued to C. M Lay on May 5, 1959, entitled "Hammer Construction with Shock Absorbing Means" is cited in U.S. Pat. No. 3,148,716 to Vaughan for the purpose of describing the effects of impact creating vibrational effects in the vicinity of the claw region of a carpenter's claw hammer.

SUMMARY OF THE INVENTION

It is an object of the present invention to provide a replaceable cap for a hammer that has a fastening pin that is free of any shearing pressure during the stroke of the hammer.

It another object of the present invention to provide a replaceable cap for a hammer that allows a user to replace a cap with one type of striking face with another cap with another type of striking face or to replace the hammer head of a replaceable cap with another type of hammer head, for example, a claw hammer with a ball peen hammer.

It is yet another object of the present invention to provide a replaceable cap for a hammer that has a shock absorbing pad.

It is yet another object of the present invention to provide a replaceable cap for a hammer head that has a pole that is slidably mounted within the chamber of the cap with the pole movable relative to the cap between a static mode and an impact mode and that includes a shock-absorbent pad that is biasable and able to move the poll that has moved from the static mode against the pad toward the cap striking face and is further able to self-biasedly return the poll to the static mode with the energy of the self-biasing action being supplied by the energy of the striking action against a workpiece.

In accordance with these objects and other objects that will become apparent in the course of this disclosure, there is provided a hammer including a hammer head with an end poll and a cap providing a selected type of cap impact face for the hammer head. The cap forms a chamber and the poll is removably slidably fitted into the poll chamber. A fastening cross-pin removably secures the cap to the pole and also allows the poll to move relative to the cap in the longitudinal dimension between an impact mode position of the cap impact face against a workpiece and a static mode position of the cap impact face remote from the workpiece. A biasable pad is positioned within the chamber formed in the cap between the cap impact face and the poll. The biasable pad absorbs shock to the hammer head during the impact mode and also returns the poll from the impact mode position to the static mode position by self-biasing action. The fastening cross-pin extends through the poll pin hole and is threadably connected to one of the cap side walls and press-fitted to the other cap side wall. The fastening cross-pin is in contact with the front surface of the poll pin hole in the static mode and moves to a free position in the poll pin hole in the impact mode so that the cross-pin avoids shear during the impact mode.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

DETAILED DESCRIPTION OF THE INVENTION

Figure 1A:
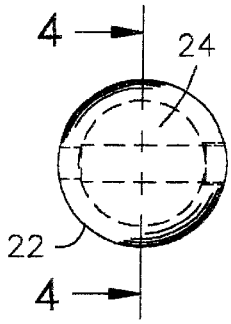
FIG. 1A is an end view of the cap impact face of the hammer cap, with a vertical, horizontal cross-sectional line 4—4.

Reference is now made to the drawings and in particular to FIGS. 1–9 in which identical or similar parts are designated by the same reference numerals throughout.

Figure 1:
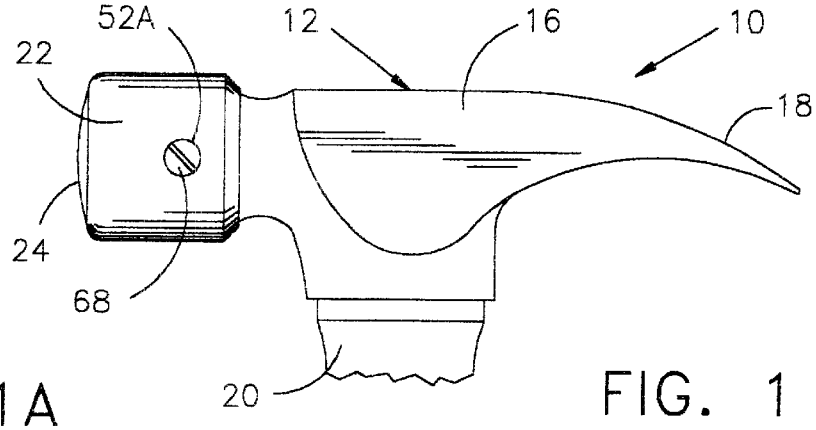
FIG. 1 is an elevational side view of the hammer of the present invention with a claw rear region with the handle shown in broken view.
Figure 2:
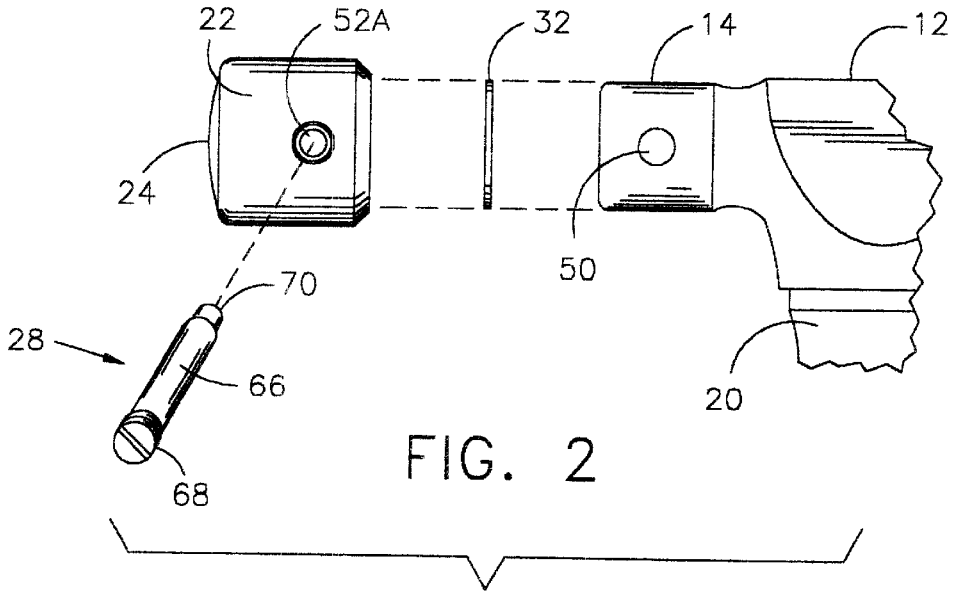
FIG. 2 is an exploded perspective view of the hammer shown in FIG. 1.

A hammer 10 shown in FIGS. 1 and 2 includes a hammer head 12 that includes a forward poll 14, a mid-region 16, a rear region claw 18 and a handle 20 connected to mid-region 16. Hammer head 12 has a longitudinal dimension extending from poll 14 to claw 18 with a handle 20 being transverse to the longitudinal dimension. Hammer 10 further includes a cylindrical cap 22 for hammer head 12 with cap 22 being removably fitted over cylindrical poll 14 with the axis of cylindrical cap 22 being axially aligned with the cylindrical axis of cylindrical poll 14. Cap 22 provides a selected type of cap impact face 24 for hammer head 12 so that cap 22 can be removed from hammer head 12 and in particular from poll 14 so that another type of cap can be placed over poll 14. The particular cap impact face 24 shown in FIGS. 1, 2, 4, 5, 6, and 7 is of a type having a slight crown or adz eye, 26, for purposes of exposition only, and in fact cap impact face 24 can be of a number of various types of striking faces known in the art.

Figure 4:
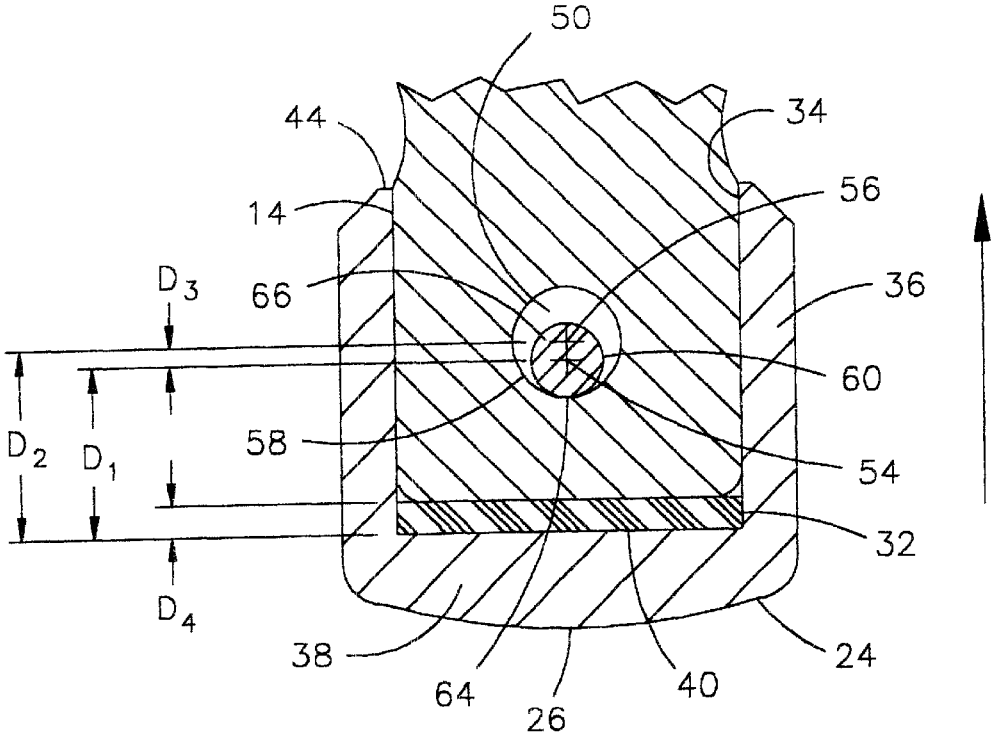
FIG. 4 is a partial, sectional view taken along the line 4—4 of FIG. 1A, showing the poll cap, biasable pad and fastening pin of the hammer shown in FIGS. 1 and 2 in the static mode, and with the cross-pin shown in a transverse (vertical) cross-section.
Figure 5:
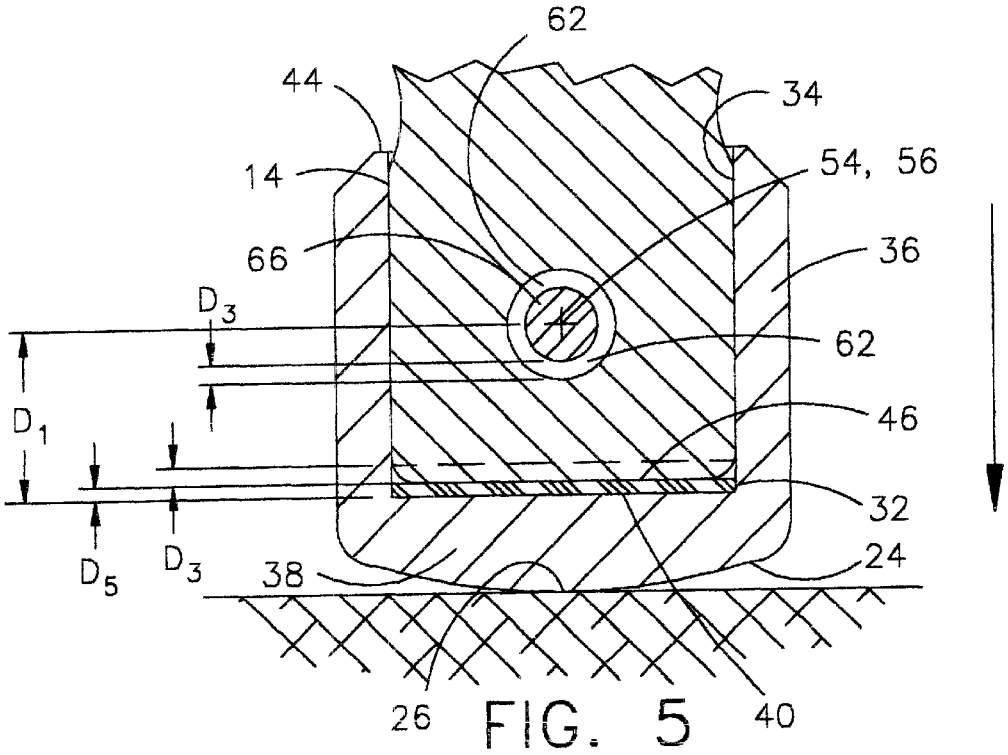
FIG. 5 is a partly sectioned side view of the hammer analogous to the view shown in FIG. 4, but in the impact mode with the space formerly occupied by the unbiased biasable pad indicated in phantom line.
Figure 6:
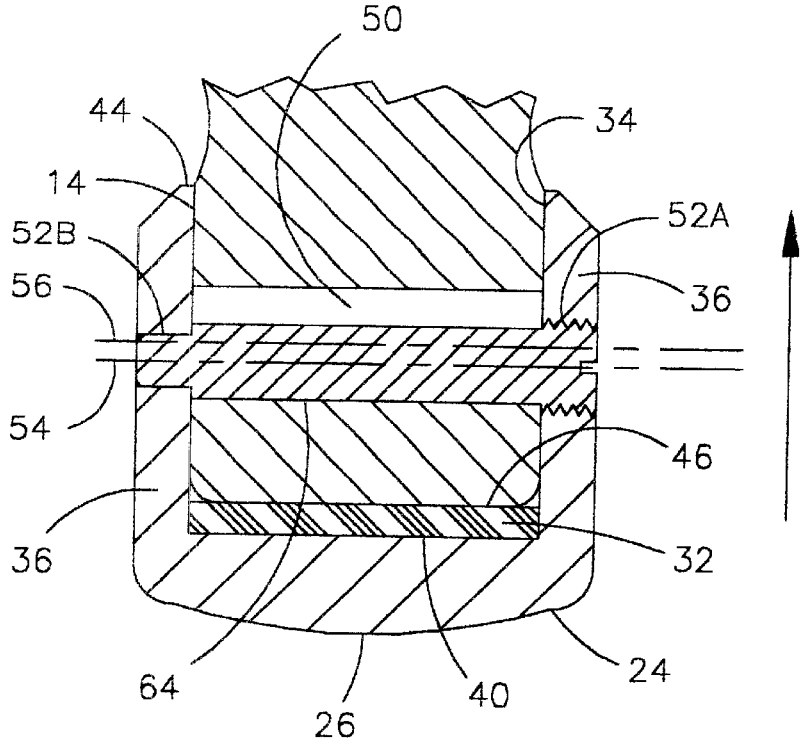
FIG. 6 is a top view of the poll cap self-biasing and fastening pin of the hammer shown in FIGS. 1 and 2 in the static mode, but with the cross-pin shown in axial cross-section.
Figure 7:
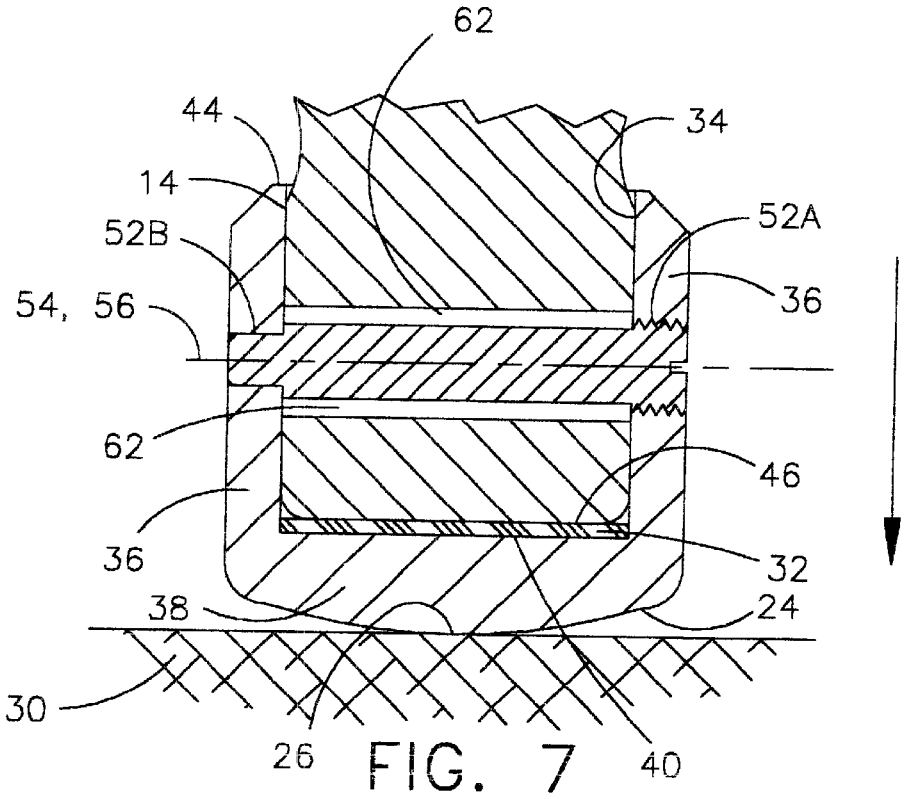
FIG. 7 is a partly sectioned view of the hammer analogous to the view shown in FIG. 6 in the impact mode.

As shown in FIGS. 1 and 2 and best seen in FIGS. 4, 5, 6, and 7, cap 22 is removably secured to poll 14 by a fastening cross-pin 28. FIGS. 4 and 6 show poll 14 and cap 22 in a non-impact, or static, mode with cap impact face 24 remote from a workpiece, such as workpiece 30 shown in FIGS. 5 and 7. FIGS. 5 and 7 show poll 14 and cap 22 in an impact mode with cap impact face 24 in striking contact with workpiece 30. Cross-pin 28 allows poll 14 to move relative to cap 22 in the longitudinal dimension between the impact mode position and the static mode position.

Figure 2A:
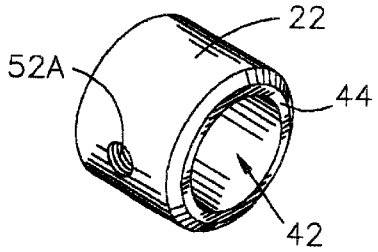
FIG. 2A is a perspective view of the cap taken in isolation showing the cap cylindrical chamber.

A shock-absorbing, biasable pad 32 both absorbs shock to harmer head 12 during the impact mode and also returns cap 22 by self-biasing action from the impact mode position shown in FIGS. 5 and 7 to the static mode position shown in FIGS. 4 and 6. Biasable pad 32 is positioned within cap 22 between cap impact face 24 and poll 14. Cap 22 forms a cap cylindrical chamber 34 defined by a longitudinally oriented cap cylindrical side wall 36 and a cap front wall 38 transverse to cap side wall 36. Cap front wall 38 includes cap external impact face 24 with adz eye 26 and an opposed cap planar interior chamber face 40 that is transverse to the axis of cylindrical cap 22. Cap chamber 34 has a circular aperture 42, best seen in FIG. 2A, opposed to cap interior chamber face 40. Circular aperture 42 is defined by the circular rim 44 of cap side wall 36.

Cylindrical poll 14 is slidably fitted to cap 22 within cap chamber 34 with the interior surface of cylindrical cap side wall 36 and is in mutual axially aligned sliding contact with the interior surface of cap cylindrical chamber 34 in the longitudinal direction. Poll 14 has a pole planar front surface 46 that is transverse to the axis of cylindrical poll 14 and that is spaced from cap planar chamber interior face 40. Biasable pad 32 is a disk, or cylindrical, in configuration as seen in FIGS. 4–7 that is axially aligned with poll 14 and cap 22. Biasable pad 32 is made of a resilient material such as rubber that is able to absorb the shock of the impact, or striking mode and thus reduces the shock to the hand and arm of the user. In addition, biasable pad 32 is forced into a biased mode with pole self-biasing capability to return to a non-biased mode so as to biasedly force poll 14 away from cap chamber face 40 at the termination of the impact mode, that is, at the end of the striking blow of hammer head 12 against workpiece 30. The space between cap planar chamber face 40 and poll planar front surface 46 varies in response to poll 14 and cap 22 being in the static mode or the impact mode so that biasable pad 32 occupies a larger or a smaller space, respectively, therebetween. The action of poll 14 relative to cap 22 between the static mode and the impact mode is analogous to that of a piston in a cylinder block despite the smallness of the movement. The energy of the impact blow of hammer head 12 against workpiece 30 is partly absorbed by biasable pad 32 to enable biasable pad 32 to force poll 14 back into the static mode during the movement of biasable pad 32 from the biased mode to the unbiased mode. In the static mode of FIGS. 4 and 6, poll planar front surface 46 is in contact with biasable pad 32 and may maintain a slight compression against biasable pad 32 in the range of 0.002 inch to 0.007 inch.

Poll 14 forms a poll pin hole 50 transverse to the longitudinal, or poll axial, direction. Cap cylindrical side wall 36 forms a pair of opposed can pin holes 52A and 52B in general alignment with poll pin hole 50. Fastening cross-pin 28 extends through poll pin hole 50 and is removably connected to cap 22 at cap pin holes 52A and 52B. Cross-pin 28 has a cross-pin axis 54 and poll pin hole 50 has a poll pin hole axis 56.

Cross-pin 28 has a cross-pin diameter and poll pin hole 50 has a poll pin hole diameter that is greater than the cross-pin diameter. Poll pin hole 50 has an inner cylindrical surface 58 and cross-pin 28 has an outer cylindrical surface 60. In the impact mode as shown in FIGS. 5 and 7 inner cylindrical surface 58 is spaced from outer cylindrical surface 60 and cross-pin axis 54 is generally aligned with poll pin hole axis 56 so that fastening cross-pin 28 is moved to a free position and a transverse annular void 62 is formed between cross-pin outer cylindrical surface 60 and poll pin hole inner cylindrical surface 58. In this manner, cross-pin 28 is moved to a free position wherein shearing pressure against fastening cross-pin 28 is avoided during the impact mode. In the static mode as shown in FIGS. 4 and 6, cross-pin axis 54 is generally axially spaced from poll pin hole axis 56 and the forward portions of cross-pin outer cylindrical surface 60 and poll pin hole inner cylindrical surface 58 have a contact area 64.

As seen in FIGS. 4 and 6 in the static mode, cross-pin axis 54 and poll pin hole axis 56 are in spaced parallel alignment. Because cross-pin 28 is connected to cap 22, cap cross-pin axis 54 is positioned at constant longitudinal first distance $D_1$ from cap chamber interior face 40. Poll pin hole axis 56 in the static mode is positioned at a second distance $D_2$ from cap chamber interior face 40. First distance $D_1$ is less than second distance $D_2$ by a distance $D_3$. Shock-absorbent biasable pad 32 occupies a longitudinal space between cap interior face 40 and poll planar front surface 46 measured by the distance $D_4$.

As seen in FIGS. 5 and 7 in the impact mode, cross-pin axis 54 and poll pin hole axis 56 are in general alignment at the distance $D_1$ measured to cap chamber interior face 40. Shock absorbent biasable pad 32 occupies a longitudinal space between cap interior 40 and poll planar front surface 46 measured by the distance $D_5$, which is less than the distance $D_4$ occupied by biasable pad 32 shown in FIGS. 4 and 6 in the static mode. The distance $D_5$ occupied by biasable pad 32 when added to the distance $D_3$ equals distance $D_4$. The distance $D_3$ between cross-pin axis 54 and poll pin hole axis 56 shown in FIG. 5 in the static mode is the same in the impact mode as shown in FIG. 5 as the reduced distance $D_3$ formerly occupied by biasable pad 32.

Figure 3:
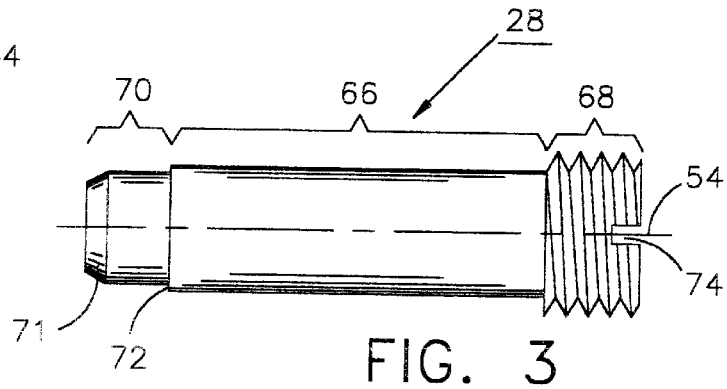
FIG. 3 is an isolated side view of the fastening pin.

As shown in FIG. 3 and in FIGS. 6 and 7, cross-pin 28 includes a main pin portion 66, a threaded end 68 and an opposed pin locator end 70. Cap pin hole 52A is a threaded pin hole that threadably holds pin threaded end 68 and cap pin hole 52B is a locator pin hole that grips pin locator end 70 by a press fit. Locator pin hole 52B has a diameter less than the diameter of cross-pin 28 and pin locator end 70 has a pin locator end diameter generally the same as the diameter of locator pin hole 52B. A locator nose 71 extends from pin locator end 70. The main pin portion diameter is greater than the pin locator portion diameter wherein cross-pin 28 defines a cylindrical shoulder stop 72 between main pin portion 66 and pin locator end 70. As best seen in FIG. 7, stop 72 is positioned at cap cylindrical side wall 36. Threaded end 68 can be rotated with a screw driver into screw recess 74 so that cross-pin 28 can be rotated inwardly until pin locator end 70 is press fitted into locator pin hole 52B so that cross-pin 28 fastens cap 22 to poll 14. Stop 72 prevents over-tightening of cross-pin 28 with poll 14.

Figure 8A:
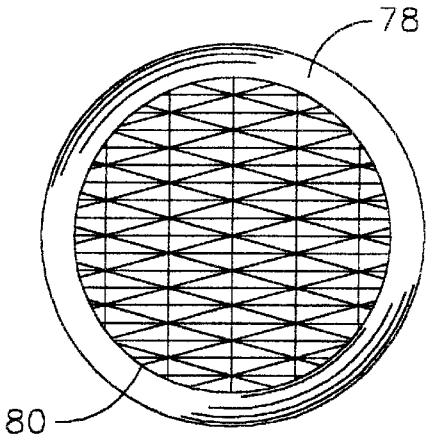
FIG. 8A is a front view of a cap in isolation having a knurled impact face.
Figure 8B:
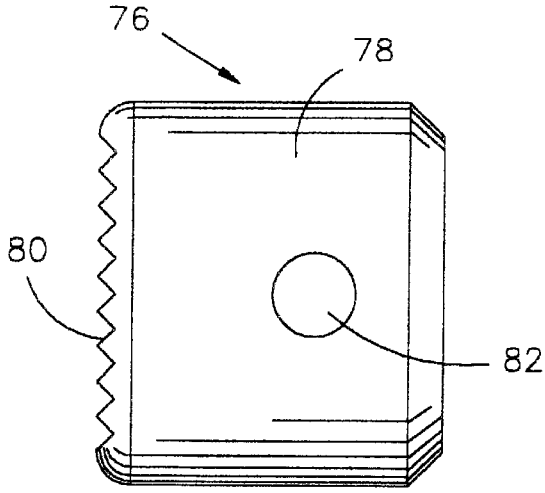
FIG. 8B is a side view of the cap shown in FIG. 8A.

FIGS. 8A and 8B show an alternate cap 76 that can be fitted over and secured to a hammer head such as hammer head 12. Alternate cap 76 includes a cylindrical cap side wall 78 and a transverse knurled face 80. A cap sidewall threaded pin hole 82 in sidewall 78 is shown devoid of a fastening pin.

Figure 9:
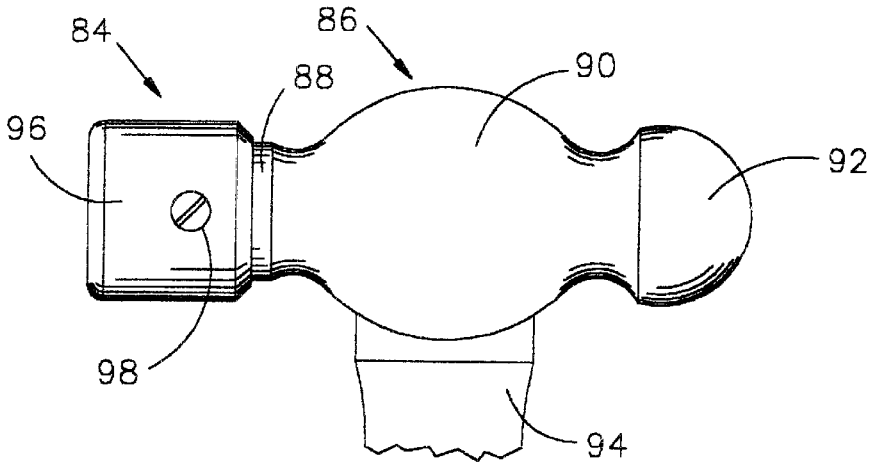
FIG. 9 is an elevational side view of an alternate inventive hammer having a ball peen rear region.

FIG. 9 is an elevational view of a hammer 84 having a hammer head 86 that includes a poll portion 88, a midportion 90, and a rear portion that comprises a ball peen 92. Hammer 84 includes a handle 94 attached to hammer head midportion 90. In accordance with the present invention, a cap 96, which is identical to cap 22 shown in FIGS. 1–7 is mounted to poll 88 and fastened to poll 88 by cross-pin 98 in a manner analogous to cross-pin 28 of FIGS. 1–7. In this manner, an alternate aspect of the invention is seen other than that of replacing a worn out cap, or replacing one type of cap with another type of cap onto a hammer head is shown in FIG. 9, in that a cap can be removed from one type of hammer head having one type of rear region, for example, a claw, and placed upon another type of hammer head having a different rear region, for example, ball peen 92.

Although the present invention has been described in some detail by way of illustration and example for purposes of clarity and understanding, it will, of course, be understood that various changes and modifications may be made in the form, details, and arrangements of the parts without departing from the scope of the invention. For example, the hammer head may have alternate configurations from the cylindrical poll and cap shown and discussed herein. For instance, a rectangular poll and a rectangular cap can obviously be substituted for the cylindrical poll and cap. Many different types of striking faces for the cap can be used other than the substantially flat striking head with the adz eye and the knurled striking face shown and discussed. The material of the cap can vary, but generally it is a hardened steel or a stainless steel. The cap not only is replaceable when worn out, but it can be made of a heavier metal than the hammer head, which can be, for example, made of a relatively light weight metal such as titanium that does not have the hardness and wearing capability of the steel cap.

What is claimed is:

1. A hammer including a handle, comprising a hammer head having a longitudinal dimension including a cylindrical poll;

cap means for providing a selected type of cap impact face for said hammer head, said cap means being removably fitted over said poll, and further includes a cylindrical cap that forms a cylindrical cap chamber defined by a longitudinal cap side wall and a cap front wall transverse to said cap side wall, said cap front wall including said cap impact face and an opposed cap interior chamber face, said cap chamber having an aperture opposed to said cap interior chamber face, said poll being slidably fitted to said cap means in said chamber;

fastening means for removably securing said cap means to said poll and for allowing said poll to move relative to said cap means in the longitudinal dimension between an impact mode position of said cap impact face against a work object and a static mode position of said cap impact face remote from the work object, and cylindrical biasable pad means for absorbing shock to said hammer head during the impact mode and for self-biasedly returning said pole from the impact mode position to the static mode position, and said biasable pad being positioned within side cap means between said cap impact face and said poll;

said poll having a poll front surface spaced from said cap interior chamber face, and said biasable pad means being positioned therebetween;

said biasable pad being positioned between said poll front surface and said cap chamber interior face, and being movable between a biased mode and an unbiased mode, wherein in the impact mode said biasable pad is in the biased mode and in the static mode said biasable pad has been self-biased to the biased mode; wherein said poll moves longitudinally toward said cap interior face at the impact mode and said poll front surface is pressed against said biasable pad, wherein said biasable pad is moved a longitudinal distance into the biased mode; and wherein said fastening means includes said poll forming a poll pin hole transverse to the longitudinal direction, and said cap side wall having a pair of opposed cap pin holes in general alignment with said poll pin hole, and said fastening means further includes a cross-pin extending through said poll pin hole and removably connected to said cap at said pair of opposed cap pin holes.

2. The hammer as set forth in claim 1, wherein said cross-pin has a cross-pin axis and said poll pin hole has a poll pin hole axis, and wherein in the static mode said cross-pin axis and said poll pin hole axis are in parallel alignment and with said cross-pin axis being at a longitudinal first distance ($D_1$) from said cap chamber interior face and said poll pin hole axis is at a longitudinal second distance ($D_2$) from said cap chamber face, said first distance ($D_1$) being greater than said second distance ($D_2$) by a longitudinal third distance ($D_3$).

3. The hammer as set forth in claim 2, wherein in said static mode said biasable pad occupies a longitudinal space measured by a longitudinal fourth distance ($D_4$), and wherein in said impact mode said cross-pin axis and said poll pin hole axis are in general alignment at said first distance ($D_1$) from said cap chamber interior face and said biasable pad occupies a space measured by a longitudinal fifth distance ($D_5$) that when added to said third distance ($D_3$) equals said fourth distance ($D_4$).

4. The hammer as set forth in claim 1, wherein said poll pin hole is cylindrical having a poll pin hole diameter and said cross-pin is cylindrical having a cross-pin diameter, said pole pin hole diameter being greater than said cross-pin diameter, and wherein in the impact mode said cross-pin is generally axially aligned with said poll pin hole axis so as to occupy a free position relative to said poll pin axis wherein an annular void is defined therebetween.

5. The hammer as set forth in claim 4, wherein said poll pin hole has an inner cylindrical surface and said cross-pin has an outer cylindrical surface, wherein in the impact mode said inner cylindrical surface is spaced from said outer cylindrical surface.

6. The hammer as set forth in claim 4, wherein said poll pin hole has a forward annular surface and wherein in the static mode said cylindrical cross-pin is positioned in contact with said forward annular surface and said poll front surface is in contact with said biasable pad.

7. The hammer as set forth in claim 1, wherein in the static mode said poll front surface is in contact with said biasable pad so as to maintain a slight compression against said biasable pad in the range of 0.002 inch to 0.007 inch.

8. The hammer as set forth in claim 1, wherein said cross-pin includes a main pin portion having a threaded end and an opposed pin locator end, and wherein one of said pair of cap pin holes in a threaded pin hole holding said threaded end and the other of said pair of cap pin holes is a locator pin hole holding said pin locator end.

9. The hammer set forth in claim 8, wherein said main pin portion has a diameter and said locator pin hole has a diameter less than the diameter of said main pin portion of said fastening means and wherein said pin locator end has a diameter generally the same as the diameter of said locator pin hole, said main pin portion diameter being greater than said pin locator end diameter wherein said cross-pin defines a stop between said main pin portion and said pin locator end, said stop being positioned at said cap side wall.

10. The hammer as set forth in claim 1, said hammer head having a rear region opposed to said poll wherein said rear region is a claw end.

11. The hammer as set forth in claim 1, said hammer head having a rear region opposed to said poll, wherein said rear region is a ball peen end.

12. The hammer as set forth in claim 1, wherein said selected type of cap impact face is an adz-eye face.

13. The hammer as set forth in claim 1, wherein said selected type of cap impact face is a knurled face.

14. An improved vibration damping hammer tool for attachment to a handle, and being of two-piece construction, comprising: a cap having a bore, and being connected to a poll, of a hammer head, having a clearance cross-aperture, a concealed shock absorbing/resilient pad disposed between said cap and said head of said hammer, a cross-pin of a cross-section smaller than that of said clearance cross-aperture for providing movement of said cross-pin, and being anchored to said cap for securing said cap to said hammer head so that in a static mode said pad is maintained under some compression; and wherein when said cap is struck against a workpiece and moves into an impact mode said pad is compressed further and restores said cap to said static mode while maintaining said pad in compression with a single hammer strike so that contact is continually made between said cap and said poll through the compressed shock absorbing/resilient pad.

15. The hammer tool of claim 14, wherein said cross-pin is removable.

16. The hammer tool of claim 14, wherein said cap is provided with a striking surface selected from the group consisting of smooth, knurled, flat, adz eye, round, ball-shaped and grooved.

17. The hammer tool of claim 14, wherein said cap is made of a heavier metal than said hammer head.

18. The hammer tool of claim 17, wherein said cap has a hardness greater than that of said hammer head.

19. The hammer tool of claim 14, wherein said hammer is made of titanium.

20. The hammer tool of claim 14, wherein said cross-pin has at one end a threaded portion and at its opposite end a straight pin portion which cooperate with like apertured portions provided in said cap for securing said cap to said poll.

21. A hammer for connection to a handle, comprising a bored cap connected to a poll of a hammer head provided with an oversized cross-hole, a removable, replaceable resilient pad in said bore of said cap; a cross-pin sized to freely move within said cross-hole, and anchored to said cap for maintaining said cap and hammer as a single unit, whereby in a static mode said pad is under compression; and upon said cap striking an object in an impact mode said pad is further compressed, and restores said cap in said static mode while maintaining said pad in compression with a single hammer strike so that contact is continually made between said cap and said poll through the compressed resilient pad.

22. The hammer of claim 21, wherein said cross-pin is removable, and either or both of said pad and cap are replaceable.

23. The hammer of claim 21, wherein said cap and hammer head are made of the same material.

24. The hammer of claim 23, wherein said cap and hammer head are made of different materials.

25. The hammer of claim 24, wherein said cap and hammer head are made of metals, and said cap is of heavier material than that of said hammer head.

26. The hammer of claim 25, wherein said hammer head is made of titanium.

27. The hammer as set forth in claim 25, wherein said cap metal is a hardened steel.

28. The hammer as set forth in claim 25, wherein said hammer head metal is titanium.

29. The hammer of claim 24, wherein said cap has a hardness at least as high as that of said hammer head.

30. The hammer of claim 21, wherein said cross-pin has at one end a threaded portion and at its opposite end a straight pin portion which cooperate with like respective threaded and bored apertures provided in the cap wall for securing said cap to said poll.

31. The hammer as set forth in claim 21, wherein said cap is made of a cap metal and said hammer head is made of a hammer head metal, said cap metal being of a different type of metal than said hammer head metal.

32. The hammer as set forth in claim 21, wherein said cap and said hammer head are made of titanium.

33. The hammer as set forth in claim 21, wherein opposite ends of said cross-pin are secured to said cap in cap cross-pin holes extending transverse to said cap.

34. The hammer as set forth in claim 33, wherein said cross-pin is frictionally secured to said cross-pin holes in said cap.

35. A hammer comprising:

a handle;

a head connected to said handle;

a cap slidably connected to said head;

a fastener adapted to permit slidable movement of said cap relative to said head;

a resilient pad disposed between and in contact with said head and said cap.

36. A hammer in accordance with claim 35 wherein said cap defines a cavity therein, and a portion of said head is slidably received within said cavity.

37. A hammer in accordance with claim 35 wherein said pad is replaceable.

38. A hammer in accordance with claim 35 wherein said fastener further comprises a pin.

39. A hammer in accordance with claim 38 wherein said pin is removably connected to said cap.

40. A hammer in accordance with claim 35 wherein said head has a longitudinal dimension and an aperture therethrough, said aperture being arranged at a perpendicular to said longitudinal dimension.

41. A hammer in accordance with claim 40 wherein said fastener further comprises a pin connected to said cap and arranged to have a portion of said pin disposed in said aperture.

42. A hammer in accordance with claim 40 wherein said pin has a cross section and said aperture has a cross section that is larger than said cross section of said pin.

43. A hammer comprising:

a handle, a head connected to said handle, said head having a longitudinal axis and further comprising a poll and an aperture through said head, said aperture having an axis perpendicular to said longitudinal axis, a cap defining a cavity and being slidably connected to said poll, a resilient pad disposed between said cap and said poll.

44. A hammer in accordance with claim 43 wherein said head and said cap are made of different materials.

45. A hammer in accordance with claim 43 wherein said pad is replaceable.

46. A hammer in accordance with claim 43 wherein said aperture has a cross section and said hammer further comprises a pin having a cross section smaller than the cross section of said aperture and being connected to said cap.

47. A hammer in accordance with claim 46 wherein said pin is removable.

48. A hammer in accordance with claim 46 wherein said pad remains in contact with said cap and said poll.

49. A hammer in accordance with claim 46 wherein said aperture has a forward surface and wherein in a static mode said pin contacts said forward surface of said aperture and said cap and poll are in contact with said pad.

50. A hammer in accordance with claim 49 wherein when said hammer is used to strike an object with said cap, said pin is moved rearward within said aperture and said pad is compressed.

51. A hammer in accordance with claim 49 wherein in said static mode said pad is held under slight compression between said cap and said poll.

52. A hammer in accordance with claim 51 wherein when said hammer is used to strike an object with said cap, said pin is moved rearward within said aperture and said pad is further compressed.

53. A hammer comprising:

a handle;

a head means for supporting a removable cap means, said head means being connected to said handle and having a longitudinal axis;

a cap means for providing a selected type of impact face for said head means, said cap means slidably engaging said head means;

fastening means for connecting said cap means to said head means; and pad means disposed between said head means and said cap means for absorbing shock to said cap means when said hammer is used to strike an object with said cap means.

54. A hammer in accordance with claim 53 wherein said cap means defines a cavity therein, and a portion of said head means is slidably received within said cavity.

55. A hammer in accordance with claim 53 wherein said pad means is replaceable.

56. A hammer in accordance with claim 53 wherein said fastener means further comprises a pin.

57. A hammer in accordance with claim 56 wherein said pin is removably connected to said cap means.

58. A hammer in accordance with claim 53 wherein said head means has an aperture therethrough, said aperture being arranged at a perpendicular to said longitudinal axis.

59. A hammer in accordance with claim 58 wherein said fastener means further comprises a pin connected to said cap means and arranged to have a portion of said pin disposed in said aperture.

60. A hammer in accordance with claim 59 wherein said pin has a cross section and said aperture has a cross section that is larger than said cross section of said pin.

* * * * *